US012559875B2

(12) United States Patent
Asami et al.

(10) Patent No.: US 12,559,875 B2
(45) Date of Patent: Feb. 24, 2026

(54) SEWING MACHINE EXTERNAL UNIT

(71) Applicant: JUKI CORPORATION, Tokyo (JP)

(72) Inventors: Takeshi Asami, Tokyo (JP); Yoshiaki Abe, Tokyo (JP); Masaru Yamada, Tokyo (JP); Eiichi Karasawa, Tokyo (JP); Toshiaki Sakaeda, Tokyo (JP); Takashi Shibuya, Tokyo (JP); Honoka Iimura, Tokyo (JP); Naofumi Fukuba, Tokyo (JP)

(73) Assignee: JUKI CORPORATION, Tokyo (JP)

( * ) Notice: Subject to any disclaimer, the term of this patent is extended or adjusted under 35 U.S.C. 154(b) by 0 days.

(21) Appl. No.: 18/522,163

(22) Filed: Nov. 28, 2023

(65) Prior Publication Data

US 2024/0175182 A1 May 30, 2024

(30) Foreign Application Priority Data

Nov. 29, 2022 (JP) ..... 2022-190734

(51) Int. Cl.
*D05B 29/02* (2006.01)
*D05B 69/30* (2006.01)

(52) U.S. Cl.
CPC ..... *D05B 29/02* (2013.01); *D05B 69/30* (2013.01)

(58) Field of Classification Search
CPC . D05B 29/02; D05B 3/24; D05B 3/06; D05B 3/243; D05C 5/00; D05C 5/02;
(Continued)

(56) References Cited

U.S. PATENT DOCUMENTS 4,343,249 A * 8/1982 Takenoya ..... D05B 3/24 112/443
5,284,104 A * 2/1994 Hori ..... D05B 19/12 112/102.5

(Continued)

FOREIGN PATENT DOCUMENTS

CN 209508576 U * 10/2019
JP S5552790 4/1980

(Continued)

OTHER PUBLICATIONS

"Search Report of Europe Counterpart Application", issued on Mar. 25, 2024, p. 1-p. 8.

(Continued)

*Primary Examiner* — Patrick J. Lynch
(74) *Attorney, Agent, or Firm* — JCIPRNET

(57) ABSTRACT

A sewing machine external unit includes: a holder holding fabric; a driver being detachable from a bed of a sewing machine and driving the holder along an upper surface of the bed; a pressing member moving in an up-down direction according to movement of a sewing needle in the up-down direction, pressing the fabric while the sewing needle is stuck in the fabric, and rising together with the sewing needle in response to the sewing needle coming out of the fabric and rising; a position detector detecting a position of the pressing member in the up-down direction; a signal output part outputting a signal to the sewing machine; and a controller outputting a needle drive signal for driving the sewing needle from the signal output part to the sewing machine, and controlling driving of the holder and/or the sewing needle based on a detection result of the position detector.

6 Claims, 13 Drawing Sheets

(58) Field of Classification Search
CPC ... D05C 9/00; D05C 9/04; D05C 9/06; D05C 9/10; D05C 9/18
See application file for complete search history.

(56) References Cited

U.S. PATENT DOCUMENTS

| | | | | |
|---|---|---|---|---|
| 2009/0217850 | A1* | 9/2009 | Tokura | D05C 9/04 112/102.5 |
| 2011/0056420 | A1* | 3/2011 | Kawaguchi | D05C 9/04 112/103 |
| 2012/0006241 | A1* | 1/2012 | Nishiyama | D05B 55/14 112/221 |
| 2015/0122165 | A1* | 5/2015 | Maki | D05B 81/00 700/134 |
| 2016/0258093 | A1* | 9/2016 | Koike | D05B 69/28 |
| 2017/0121878 | A1 | 5/2017 | Koike et al. | |
| 2019/0352823 | A1* | 11/2019 | Tachikawa | D05B 19/10 |
| 2021/0269954 | A1* | 9/2021 | Yokoyama | D05C 9/06 |
| 2023/0304203 | A1* | 9/2023 | Hamajima | D05B 3/243 |

FOREIGN PATENT DOCUMENTS

| | | | | |
|---|---|---|---|---|
| JP | S5558167 | | 4/1980 | |
| JP | S55108004 | | 8/1980 | |
| JP | 2008086427 | A * | 4/2008 | D05B 19/16 |
| JP | 2019212194 | | 12/2019 | |
| TW | I709676 | B * | 11/2020 | |
| WO | WO-2005113876 | A2 * | 12/2005 | D05B 11/00 |

OTHER PUBLICATIONS

"Office Action of Europe Counterpart Application", issued on Apr. 4, 2025, pp. 1-6.

* cited by examiner

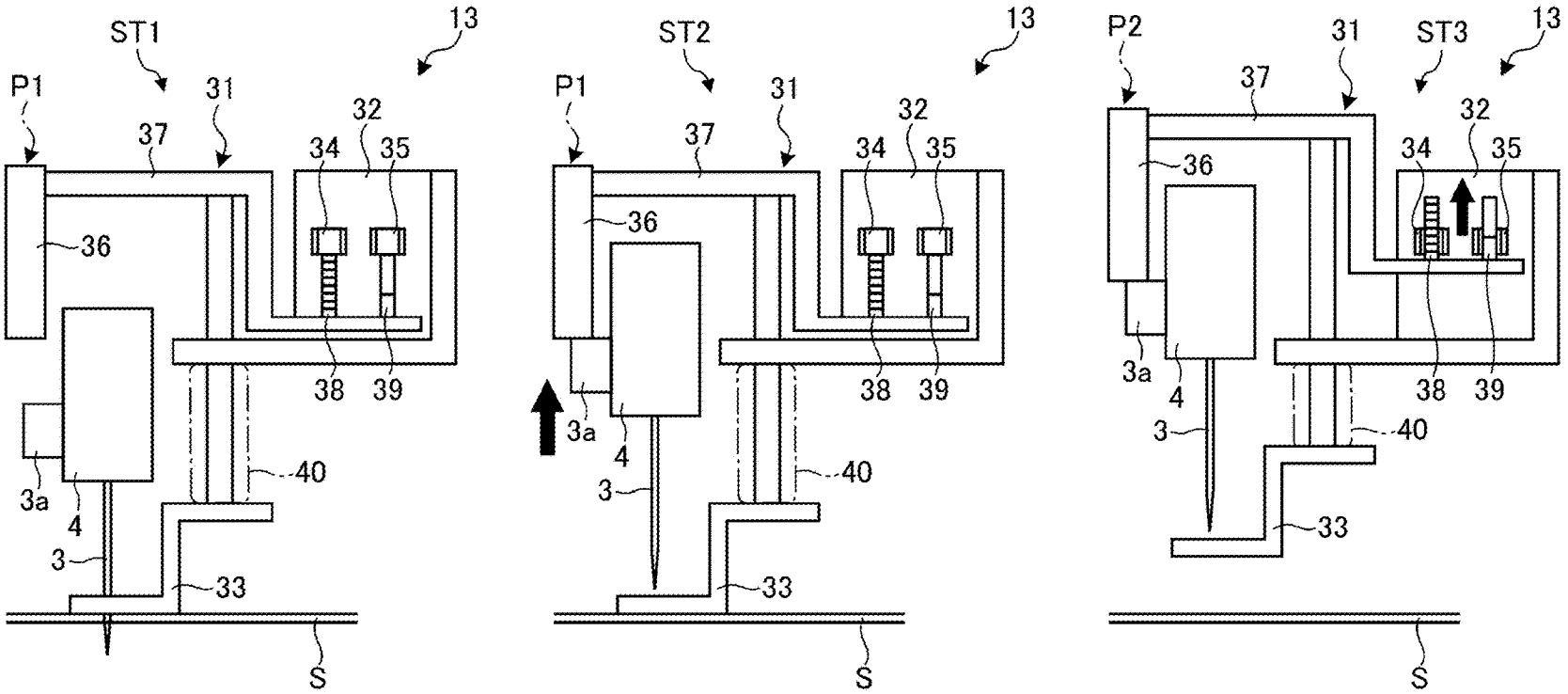
FIG. 7A
FIG. 7B
FIG. 7C
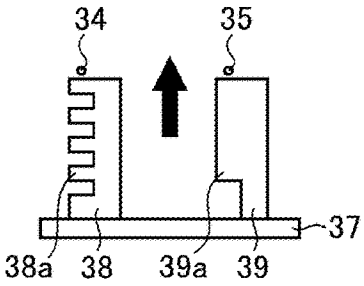
FIG. 7D
FIG. 7E
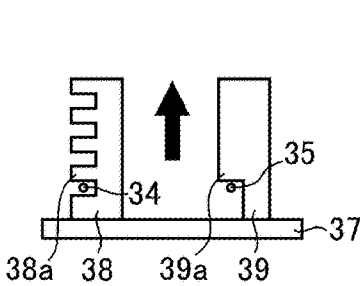
FIG. 7F

SEWING MACHINE EXTERNAL UNIT

CROSS-REFERENCE TO RELATED APPLICATION

This application claims the priority benefits of Japanese application no. 2022-190734, filed on Nov. 29, 2022. The entirety of the above-mentioned patent application is hereby incorporated by reference herein and made a part of this specification.

BACKGROUND

Technical Field

The disclosure relates to a sewing machine external unit.

Description of Related Art

In the technical field related to sewing machines, a so-called lock-stitch sewing machine, as disclosed in Patent Document 1 (Japanese Patent Application Laid-Open No. 2019-212194), is known.

When sewing buttonholes with the sewing machine mentioned above, for example, a frame that holds the fabric, a ratchet mechanism that converts the power of vertical movement of a sewing needle into a horizontal driving force of the frame, and a top with movement engraved are used to move the frame in the shape of the buttonholes. It is desired to improve the quality of seams when sewing patterns such as buttonholes using the sewing machine.

The disclosure provides a sewing machine external unit that is capable of improving the quality of seams in sewing using a sewing machine.

SUMMARY

According to the disclosure, a sewing machine external unit is provided, which includes: a holder configured to hold fabric; a driver configured to be detachable from a bed of a sewing machine and drive the holder along an upper surface of the bed; a pressing member configured to move in an up-down direction according to movement of a sewing needle of the sewing machine in the up-down direction, press the fabric while the sewing needle is stuck in the fabric, and rise together with the sewing needle in response to the sewing needle coming out of the fabric and rising; a position detector configured to detect a position of the pressing member in the up-down direction; a signal output part configured to output a signal to the sewing machine; and a controller configured to be capable of outputting a needle drive signal for driving the sewing needle from the signal output part to the sewing machine, and control driving of at least one of the holder and the sewing needle based on a detection result of the position detector.

The disclosure is capable of improving the quality of seams in sewing using a sewing machine.

BRIEF DESCRIPTION OF THE DRAWINGS

FIG. 7A to FIG. 7F are diagrams schematically showing an example of the operation of the position detector.

DESCRIPTION OF THE EMBODIMENTS

Hereinafter, an embodiment of a sewing machine external unit according to the disclosure will be described based on the drawings. Nevertheless, the disclosure is not limited to this embodiment. Furthermore, the components in the embodiment described below include components that can be easily replaced by those skilled in the art or components that are substantially the same.

In the embodiment, the positional relationship of each part will be described based on a sewing machine coordinate system defined for a sewing machine 1. The sewing machine coordinate system is defined by a three-dimensional orthogonal coordinate system. The sewing machine coordinate system is defined by an X-axis, a Y-axis, and a Z-axis. The X-axis is defined on a predetermined plane. The Y-axis is defined to be orthogonal to the X-axis on the predetermined plane. The Z-axis is defined to be orthogonal to the predetermined plane. In the embodiment, the predetermined plane is parallel to a horizontal plane, and a direction parallel to the Z-axis is defined as an up-down direction. Further, in the embodiment, the predetermined plane is referred to as an XY plane as appropriate.

Figure 1:
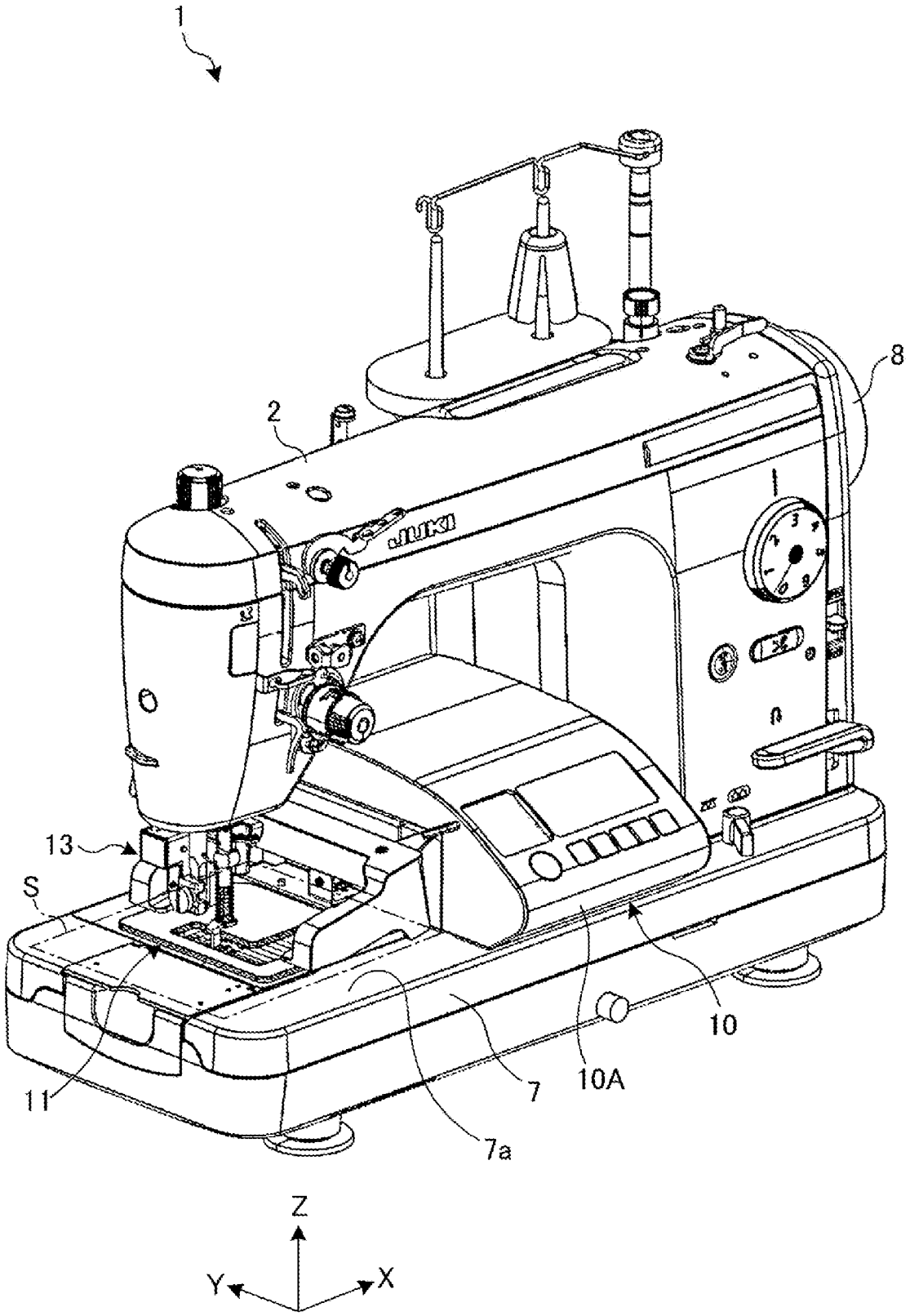
FIG. 1 is a perspective view schematically showing the sewing machine in a state where the sewing machine external unit according to an embodiment is mounted.
Figure 2:
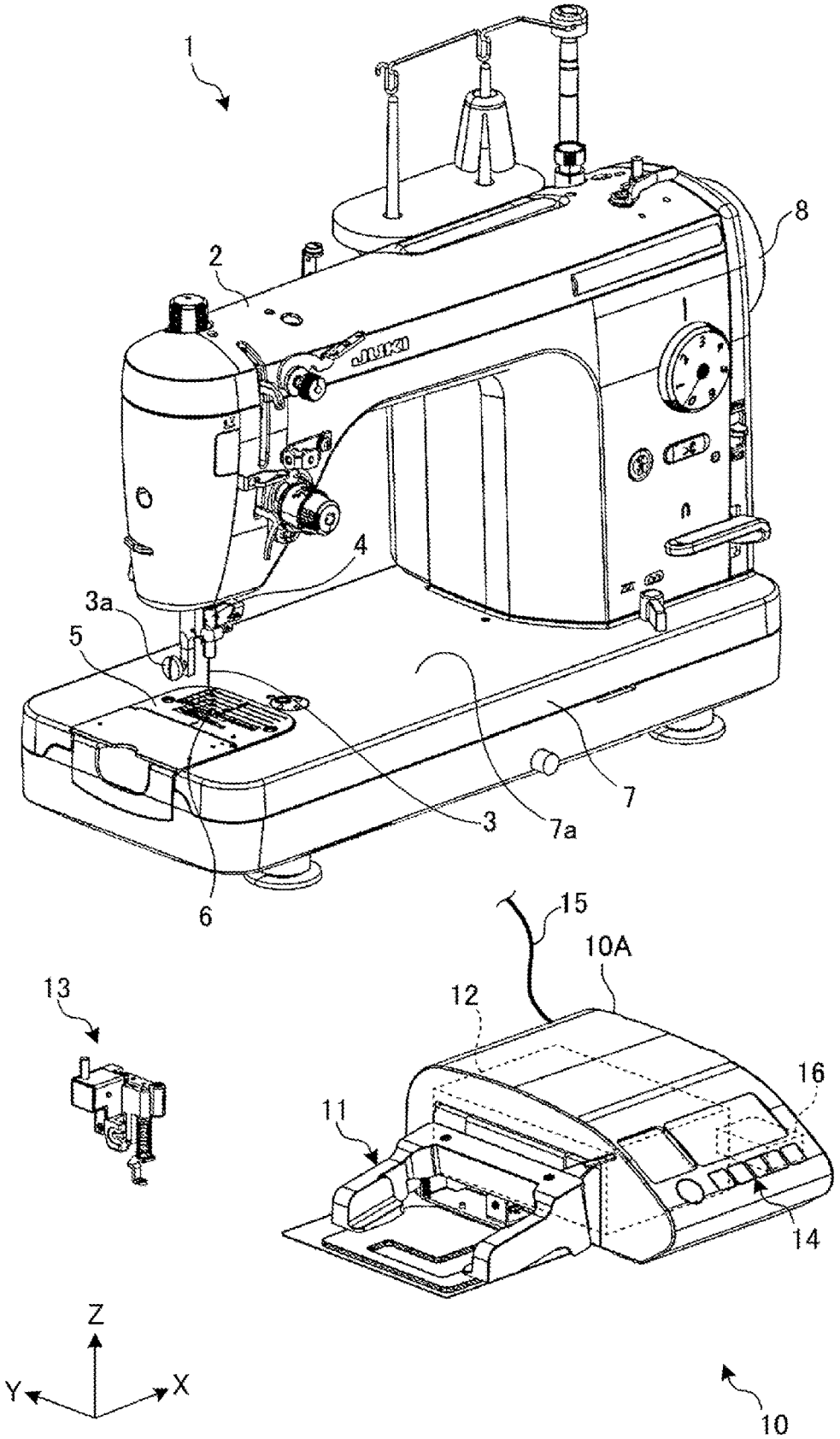
FIG. 2 is an exploded perspective view of the sewing machine and the sewing machine external unit detached from each other.

FIG. 1 is a perspective view schematically showing the sewing machine 1 in a state where a sewing machine external unit 10 according to the embodiment is mounted. FIG. 2 is an exploded perspective view of the sewing machine 1 and the sewing machine external unit 10 detached from each other. As shown in FIG. 1 and FIG. 2, the sewing machine 1 includes a sewing machine head 2, a needle bar 4 that holds a sewing needle 3 and moves back and forth in the Z-axis direction, a needle plate 5 that supports fabric S which is an object to be sewn, and the sewing machine external unit 10 for forming buttonholes.

The sewing machine head 2 supports the needle bar 4 to be movable back and forth in the Z-axis direction. The needle bar 4 is arranged above the needle plate 5 and is able to face the front side of the fabric S. The needle bar 4 holds the upper end portion of the sewing needle 3 so that the sewing needle 3 extends in the Z-axis direction. A needle thread is threaded onto the sewing needle 3.

The needle plate 5 supports the back side of the fabric S. The upper surface of the needle plate 5 is parallel to the XY plane. The needle plate 5 supports the fabric S from below. The needle plate 5 has a needle hole 6 which allows the sewing needle 3 to pass through. A hook (not shown) is arranged below the needle plate 5. The hook holds a bobbin housed in a bobbin case. A bobbin thread is wound onto the bobbin. The hook rotates in synchronization with the reciprocating movement of the needle bar 4. The bobbin thread is supplied from the hook.

The sewing machine external unit 10 is used when forming buttonholes in the fabric S. The sewing machine external unit 10 is a unit for forming buttonholes in the fabric S. The sewing machine external unit 10 includes a holder 11, a driver 12, a position detector 13, an operation panel 14, a signal output part 15, and a controller 16. In the sewing machine external unit 10, the driver 12, the operation panel 14, the signal output part 15, and the controller 16 are housed in a housing 10A. The holder 11 is supported by the driver 12 inside the housing 10A in a state of protruding from the housing 10A.

Figure 3:
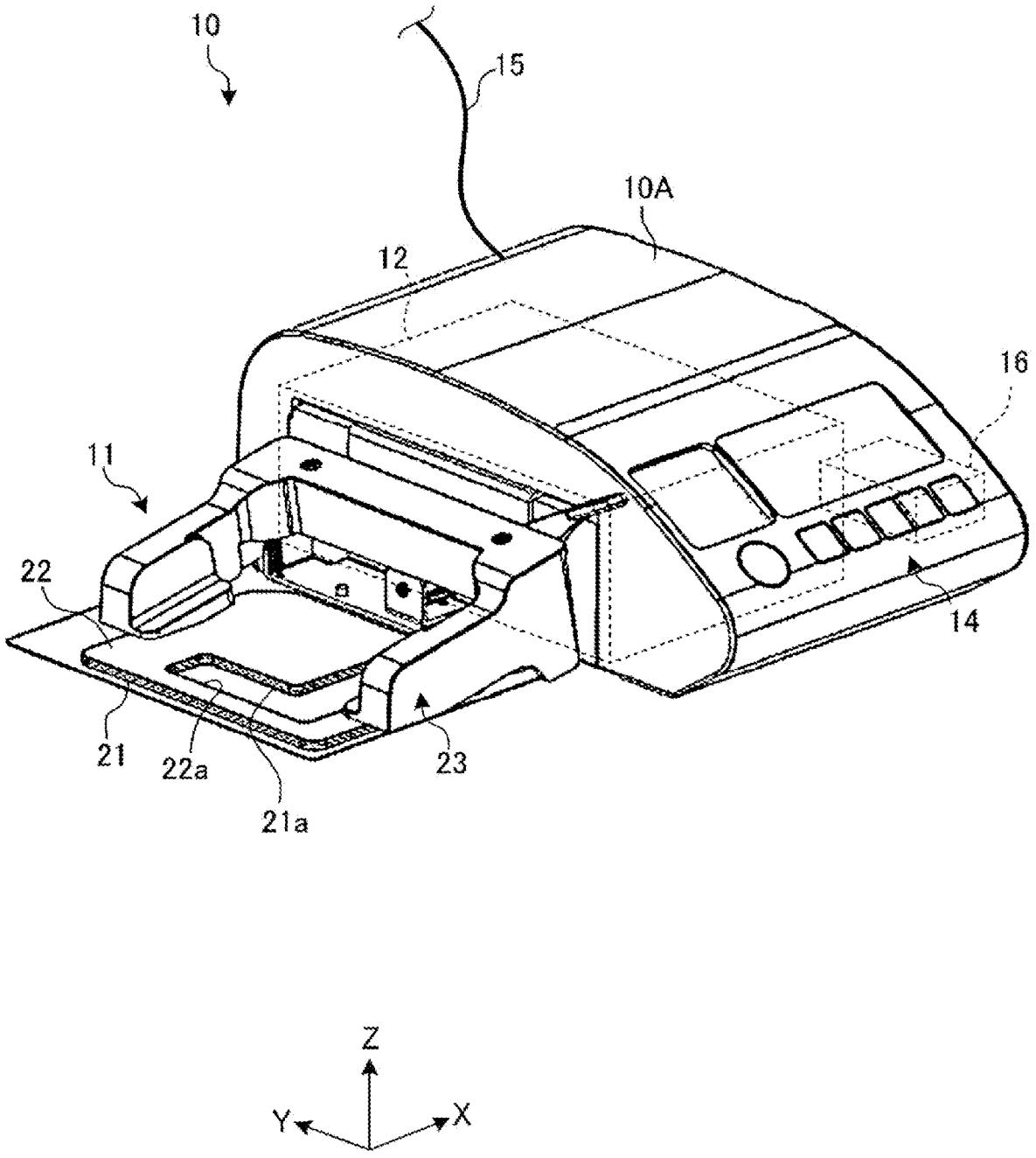
FIG. 3 is a perspective view showing an example of the appearance of the holder and the housing.

FIG. 3 is a perspective view showing an example of the appearance of the holder 11 and the housing 10A. The holder 11 holds the fabric S. The holder 11 includes a lower plate 21, an upper plate 22, and a clamp mechanism 23.

The lower plate 21 is supported at a position away from an upper surface 7*a* of a bed 7 and the needle plate 5 in the +Z direction. The upper plate 22 is movable in the Z direction with respect to the lower plate 21. By moving the upper plate 22 in the +Z direction with respect to the lower plate 21, a gap is formed between the lower plate 21 and the upper plate 22. The fabric S may be placed in this gap.

Figure 4:
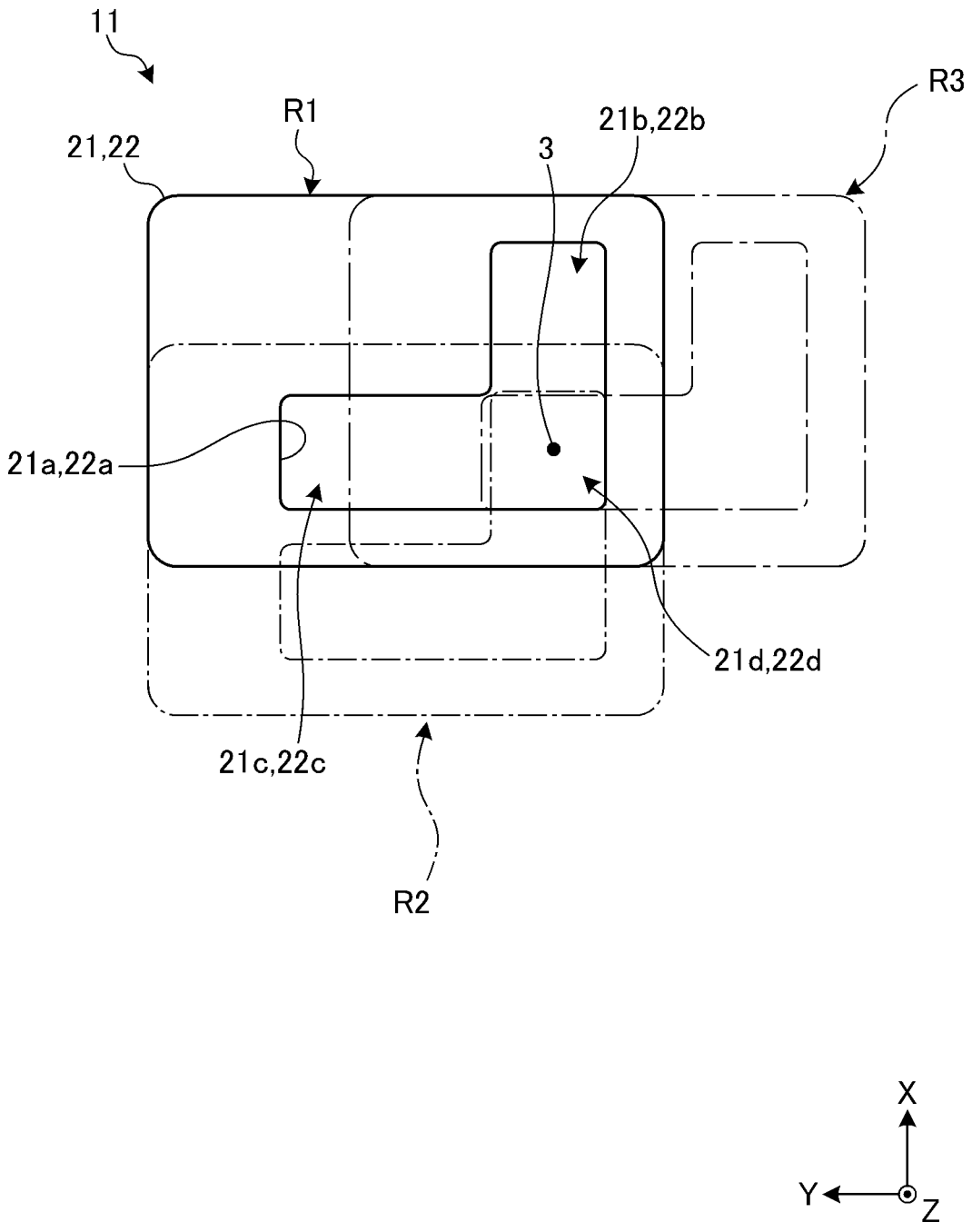
FIG. 4 is a diagram showing an example of a state where the holder is viewed from above.

FIG. 4 is a diagram showing an example of a state where the holder 11 is viewed from above. In FIG. 4, the clamp mechanism 23 is omitted. As shown in FIG. 4, the lower plate 21 and the upper plate 22 are formed to have the same shape and the same dimensions. The lower plate 21 and the upper plate 22 have openings 21*a* and 22*a* through which the sewing needle 3 passes. The openings 21*a* and 22*a* are formed in positions and dimensions that overlap when viewed from above, for example. The openings 21*a* and 22*a* are formed in an L-shape respectively having first portions 21*b* and 22*b* extending in the X direction and second portions 21*c* and 22*c* extending in the Y direction when viewed from above. The openings 21*a* and 22*a* are arranged at positions directly below the sewing needle 3. The holder 11 may be arranged at three origin positions R1 to R3 depending on the position of the sewing needle 3 and the positions of the openings 21*a* and 22*a*. At the origin position R1, the sewing needle 3 is arranged at the L-shaped corners 21*d* and 22*d* of the openings 21*a* and 22*a*. At the origin position R2, the sewing needle 3 is arranged at the tips of the first portions 21*b* and 22*b* of the openings 21*a* and 22*a*. At the origin position R3, the sewing needle 3 is arranged at the tips of the second portions 21*c* and 22*c* of the openings 21*a* and 22*a*. The origin positions are not limited to the case described above.

Figure 5A:
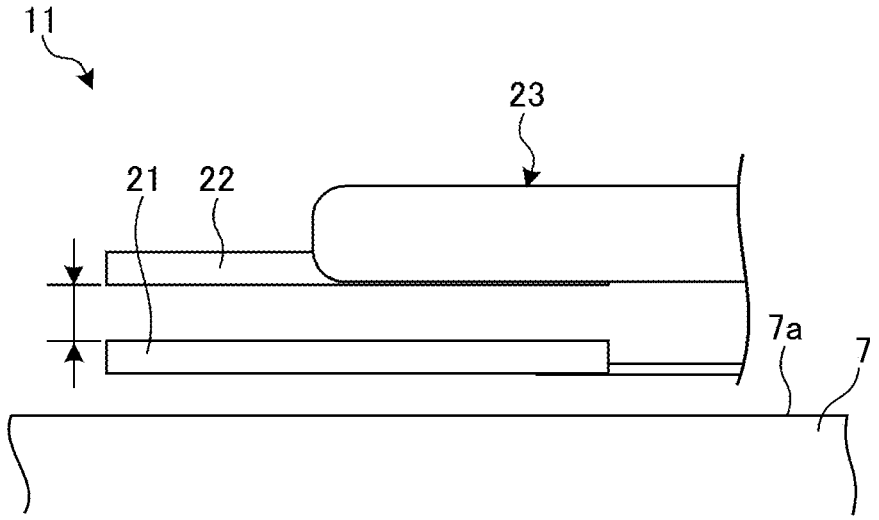
FIG. 5A and FIG. 5B are diagrams schematically showing an example of the operation of the holder.
Figure 5B:
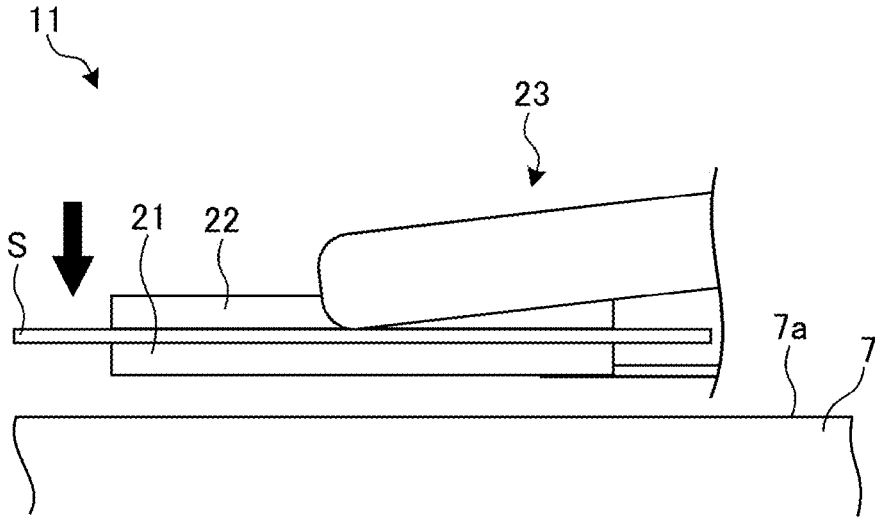

The clamp mechanism 23 presses the upper plate 22 toward the side of the lower plate 21. FIG. 5A and FIG. 5B are diagrams schematically showing an example of the operation of the holder 11. As shown in FIG. 5A and FIG. 5B, with the fabric S placed in the gap between the lower plate 21 and the upper plate 22, the clamp mechanism 23 presses the upper plate 22 against the lower plate 21 so that the fabric S is sandwiched between the lower plate 21 and the upper plate 22. By sandwiching the fabric S between the lower plate 21 and the upper plate 22, the holder 11 holds the fabric S.

The driver 12 is detachable from the bed 7 of the sewing machine 1. The driver 12 moves the holder 11 along the upper surface 7*a* of the bed 7 in the X direction and the Y direction.

The driver 12 supports the holder 11 so that the lower plate 21 does not move in the Z direction. The driver 12 includes an X drive system that moves the holder 11 in the X direction and a Y drive system that moves the holder 11 in the Y direction while supporting the holder 11. A stepping motor, for example, is used as a drive source for the X drive system and the Y drive system.

The position detector 13 detects the positions of the sewing needle 3 of the sewing machine 1 and a pressing member 33, which will be described later, in the up-down direction. The position detector 13 is mounted on the sewing machine head 2 by removing a presser plate originally provided on the sewing machine head 2, and replaces the presser plate. The position detector 13 outputs a detection result to the controller 16.

Figure 6:
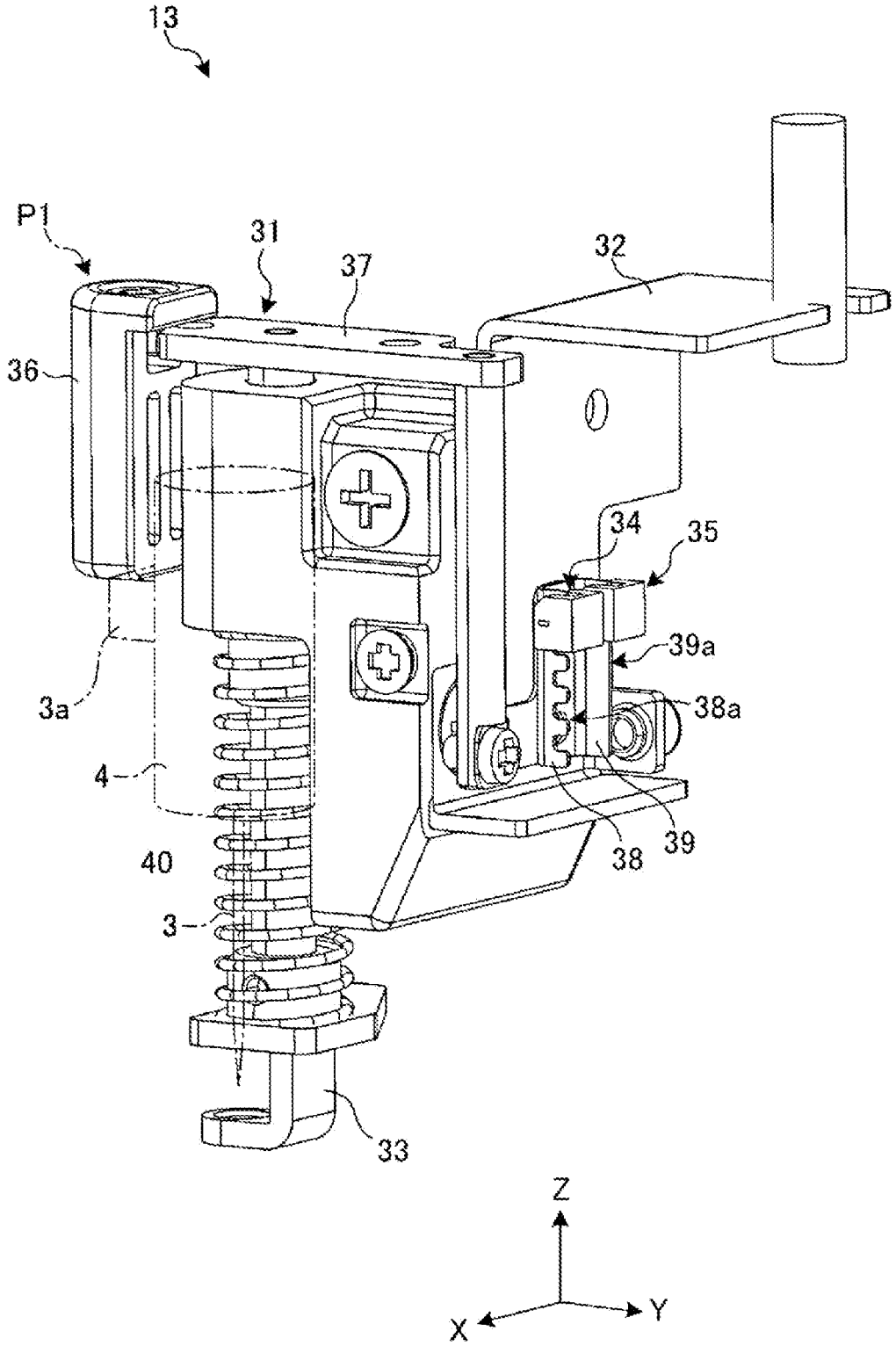
FIG. 6 is a perspective view showing an example of the position detector.

The position detector 13 includes a movable body 31, a support part 32, the pressing member 33, a first optical sensor 34, and a second optical sensor 35. FIG. 6 is a perspective view showing an example of the position detector 13. In FIG. 6, a part of the structure of the outer portion is omitted so that the inside can be seen. FIG. 7A to FIG. 7F are diagrams schematically showing an example of the operation of the position detector 13.

As shown in FIG. 6 and FIG. 7A to FIG. 7F, the movable body 31 is supported by the support part 32 to be movable in the Z direction. The movable body 31 is supported by the support part 32 to rise together with the sewing needle 3 when the sewing needle 3 comes out of the fabric S and rises. The movable body 31 includes a needle abutting member 36, a connection member 37, a first light shielding member 38, and a second light shielding member 39.

The needle abutting member 36 is arranged on the movement path of a fixing member 3*a* when the sewing needle 3 moves up and down. The needle abutting member 36 is movable in the Z direction between a first position P1 and a second position P2. The first position P1 is a position corresponding to the fixing member 3*a* when reaching a position where the sewing needle 3 rises and comes out of the fabric S or a position a predetermined distance above the position where the sewing needle 3 comes out. The second position P2 is a position corresponding to a height position of the fixing member 3*a* when the sewing needle 3 reaches the top dead center. The needle abutting member 36 is supported by the support part 32 in a state where movement downward from the first position P1 is restricted.

The connection member 37 connects the needle abutting member 36 to the first light shielding member 38 and the second light shielding member 39.

The first light shielding member 38 and the second light shielding member 39 have shapes extending in the Z direction. The first light shielding member 38 and the second light shielding member 39 move in the Z direction together with the needle abutting member 36 and the connection member 37. The first light shielding member 38 has a wavy light shielding pattern 38*a* in which uneven portions are alternately formed in the Z direction. The second light shielding member 39 has a light shielding pattern 39*a* whose lower width in the Z direction is smaller than the upper width.

The pressing member 33 is provided in place of the presser plate of the sewing machine head 2. The pressing member 33 is connected to the connection member 37. The pressing member 33 moves in the Z direction together with the connection member 37, that is, the needle abutting member 36, the first light shielding member 38, and the second light shielding member 39. The pressing member 33 is given a downward elastic force by a spring member 40. The spring member 40 has an upper end supported by the support part 32, and a lower end brought into contact with the pressing member 33. Therefore, the spring member 40 applies a downward elastic force to the entire movable body 31.

As shown in FIG. 7A to FIG. 7F, when the sewing needle 3 rises from a state ST1 in which the sewing needle 3 is stuck in the fabric S and comes out of the fabric S, a state ST2 occurs in which the fixing member 3*a* abuts the needle abutting member 36 at the first position P1. As the sewing needle 3 further rises, the needle abutting member 36 is pushed up by the fixing member 3*a*. When the sewing needle 3 reaches the top dead center, a state ST3 occurs in which the needle abutting member 36 is pushed up by the fixing member 3*a* and reaches the second position P2. The pressing member 33 rises together with the sewing needle 3 when the sewing needle 3 comes out of the fabric and rises from the state ST2 to the state ST3.

In the case where the sewing needle 3 descends from the top dead center, the force that pushes up the needle abutting member 36 no longer exists. In this case, the gravity of the movable body 31 itself and the elastic force of the spring member 40 act on the movable body 31. Due to the gravity and the elastic force, the movable body 31 moves downward along the sewing needle 3. When the sewing needle 3 pierces the fabric S, the needle abutting member 36 reaches the first position P1, and the pressing member 33 presses the fabric S toward the side of the needle plate 5. Thus, the needle abutting member 36 is placed at the first position P1 with downward movement restricted. When the sewing needle 3 moves further downward, the fixing member 3*a* separates from the needle abutting member 36 and moves downward. The pressing member 33 rises together with the sewing needle 3 when the sewing needle 3 moves downward from the top dead center.

The first optical sensor 34 is supported by the support part 32. The first optical sensor 34 includes, for example, a light emitting section and a light receiving section. The light emitting section irradiates the light shielding pattern 38*a* of the first light shielding member 38 with light. The light receiving section detects light passing through the light shielding pattern 38*a* and converts the light into an electrical signal. The first optical sensor 34 outputs the detection result to the controller 16 as an electrical signal.

The second optical sensor 35 is supported by the support part 32. The second optical sensor 35 includes, for example, a light emitting section and a light receiving section. The light emitting section irradiates the light shielding pattern 39*a* of the second light shielding member 39 with light. The light receiving section detects light passing through the light shielding pattern 39*a* and converts the light into an electrical signal. The second optical sensor 35 outputs the detection result to the controller 16 as an electrical signal.

Figure 8:
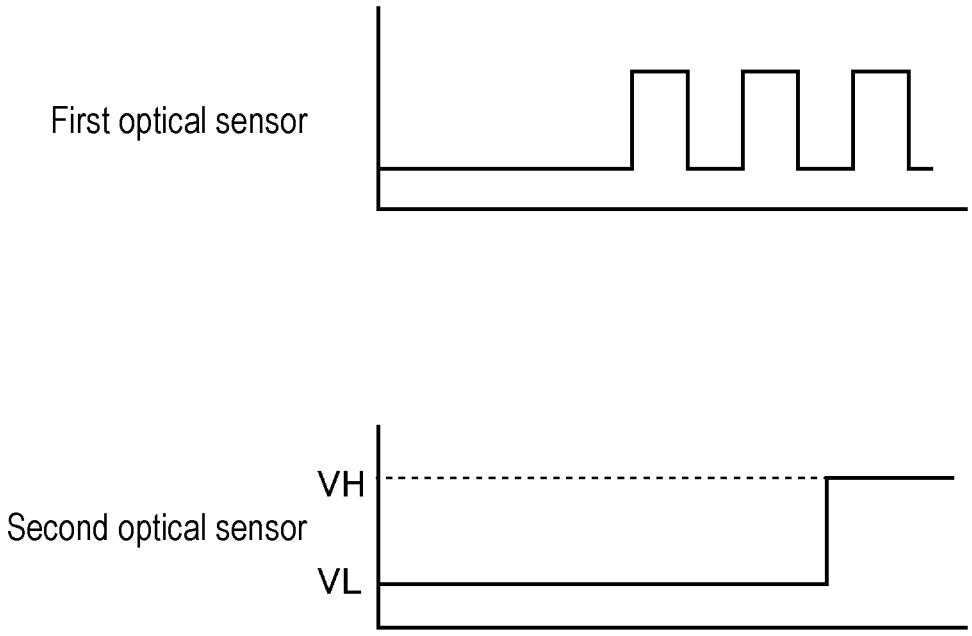
FIG. 8 is a diagram showing an example of the electrical signals output from the first optical sensor and the second optical sensor.

FIG. 8 is a diagram showing an example of the electrical signals output from the first optical sensor 34 and the second optical sensor 35. As shown in FIG. 7A to FIG.7F and FIG. 8, in the state where the sewing needle 3 is stuck in the fabric S, the needle abutting member 36 remains supported at the first position Pl and does not move. In this case, the pressing member 33 is in a state of pressing the fabric S. In this state, the light shielding pattern of the first light shielding member 38 does not move, and the first optical sensor 34 outputs an electrical signal of a constant value. On the other hand, when the sewing needle 3 rises and comes out of the fabric S, the needle abutting member 36 is pushed up by the fixing member 3*a*. As the needle abutting member 36 moves, the pressing member 33 moves upward together with the needle abutting member 36 and becomes separated from the fabric S. Further, as the needle abutting member 36 moves, the wavy light shielding pattern in the first light shielding member 38 moves upward. As the wavy light shielding pattern moves, a period in which the light receiving section receives light and a period in which the light receiving section does not receive light occur alternately in the first optical sensor 34. Thus, in the state where the pressing member 33 is separated from the fabric S, the first optical sensor 34 outputs a pulsed electrical signal.

Furthermore, in the case where the sewing needle 3 is placed below the raised position, the light from the second optical sensor 35 is blocked by the second light shielding member 39, so the second optical sensor 35 outputs a signal with a low value VL indicating a state where no light is detected. When the sewing needle 3 rises and is placed at the raised position, the needle abutting member 36 is pushed up to the second position P2, and the light from the second optical sensor 35 passes through the second light shielding member 39. In this case, the second optical sensor 35 outputs a signal with a high value VH indicating a state where light has been detected. In this way, the level of the electrical signal output from the second optical sensor 35 is different depending on whether the sewing needle 3 is placed at the raised position or below the raised position.

Returning to FIG. 3, the operation panel 14 includes an input part that inputs a predetermined operation signal to the controller 16, and a display part that displays information. The input part may include, for example, a button. The input part is capable of inputting various settings such as buttonhole pattern and dimensions, and stitch length and pitch. In addition, the input part is capable of inputting operations such as starting and pausing the buttonhole operation. The display part displays various information. A liquid crystal panel or the like is used as the display part.

The signal output part 15 outputs a signal to the sewing machine 1. The signal output part 15 is connected to, for example, a connector of the sewing machine 1 to which a signal from a foot pedal is supplied. The signal output part 15 is capable of outputting a needle drive signal for driving the sewing needle 3 to the sewing machine 1.

The controller 16 controls the sewing machine external unit 10 in an integrated manner. The controller 16 controls the driving of the holder 11 by the driver 12. The controller 16 controls a signal output operation performed by the signal output part 15. The controller 16 controls a display operation of the display part.

Figure 9:
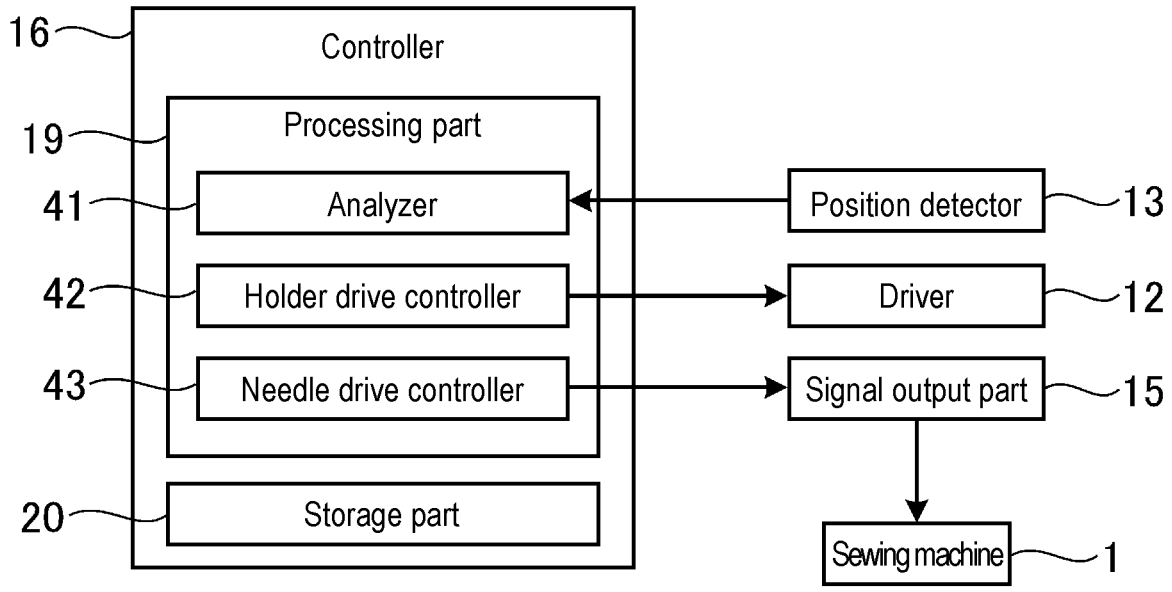
FIG. 9 is a functional block diagram showing an example of the controller.

FIG. 9 is a functional block diagram showing an example of the controller 16. As shown in FIG. 9, the controller 16 controls the operation of the sewing machine external unit 10 and the operation of a part of the sewing machine 1. The controller 16 includes a processing part 19 and a storage part 20.

The processing part 19 performs various information processing. The processing part 19 includes a processor such as a CPU (Central Processing Unit), and memories such as a ROM (Read Only Memory) and a RAM (Random Access Memory).

The processing part 19 includes an analyzer 41, a holder drive controller 42, and a needle drive controller 43.

The analyzer 41 analyzes the detection result of the position detector 13. The analyzer 41 determines the thickness of the fabric S, whether the sewing needle 3 has come out of the fabric S, or whether the pressing member 33 has been separated from the fabric S based on the detection result of the position detector 13. The analyzer 41 determines whether the sewing needle 3 has reached the top dead center or the raised position near the top dead center based on the detection result of the position detector 13.

Figure 10B:
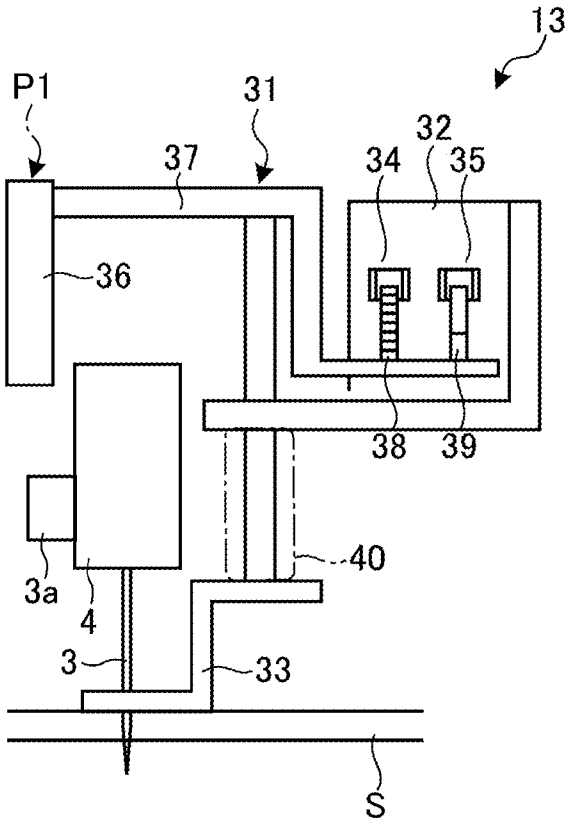
FIG. 10A and FIG. 10B schematically show the principle of detecting the thickness of the fabric.
Figure 10A:
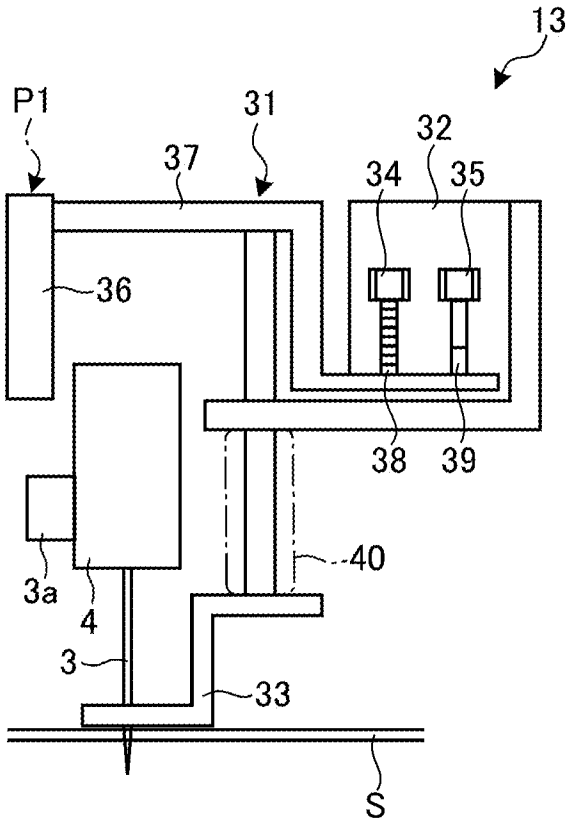
Figure 11A:
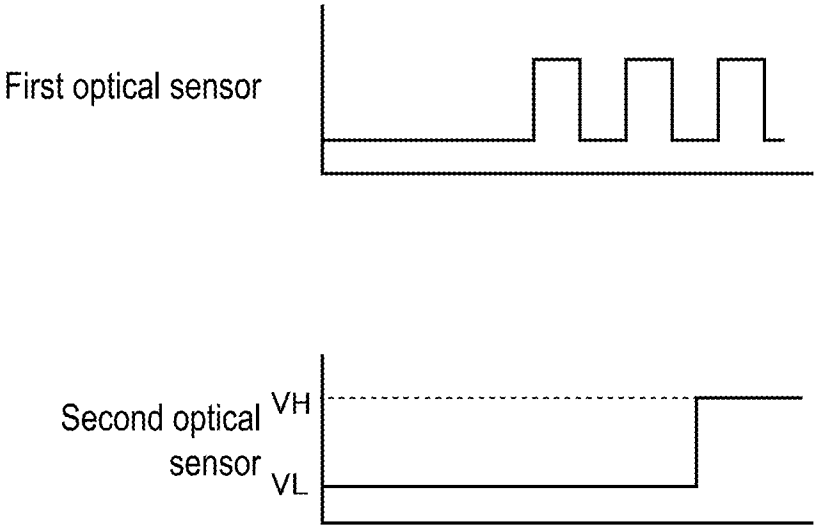
FIG. 11A and FIG. 11B are diagrams schematically showing the output from the first optical sensor when the thickness of the fabric is different.
Figure 11B:
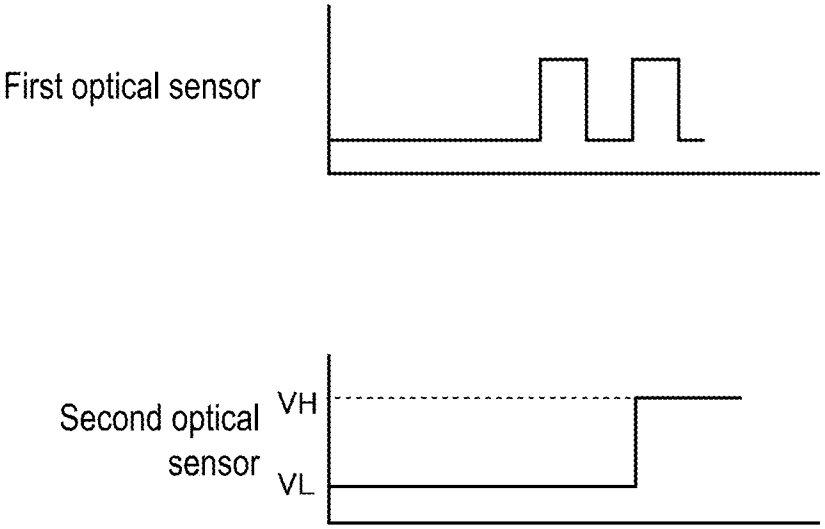

In the case of detecting the thickness of the fabric S, the analyzer 41 is capable of performing calculation based on the number of pulse signals output by the first optical sensor 34. FIG. 10A and FIG. 10B schematically show the principle of detecting the thickness of the fabric S. FIG. 10A shows a case where the fabric S is thin, and FIG. 10B shows a case where the fabric S is thick. As shown in FIG. 10A and FIG. 10B, when the fabric S is thick, the height position of the pressing member 33 in the state where the sewing needle 3 is stuck in the fabric S is higher than when the fabric S is thin. In this case, the first light shielding member 38 and the second light shielding member 39 enter deeper into the first optical sensor 34 and the second optical sensor 35 than when the fabric S is thin. In contrast, the height of the top dead center of the sewing needle 3 is constant regardless of the thickness of the fabric S. Therefore, when the sewing needle 3 rises from this state and the fixing member 3*a* pushes up the needle abutting member 36, the height at which the needle abutting member 36 is pushed up until the sewing needle 3 reaches the top dead center is shorter than when the fabric S is thin. FIG. 11A and FIG. 11B are diagrams schematically showing the output from the first optical sensor 34 when the thickness of the fabric S is different. FIG. 11A shows the output when the fabric S is thin, and FIG. 11B shows the output when the fabric S is thick. As shown in FIG. 11A and FIG. 11B, when the fabric S is thick, the number of pulse signals output by the first optical sensor 34 is smaller than when the fabric S is thin.

Based on this principle, for example, the number of pulse signals when the fabric S is absent is measured in advance, and the measurement result is stored in the storage part 20. The analyzer 41 is capable of calculating the thickness of the fabric S by comparing the number of pulse signals generated when the fabric S is present with the number of pulse signals stored in the storage part 20.

The holder drive controller 42 controls the driving of the holder 11 based on the analysis result of the analyzer 41 or the like. The holder drive controller 42 controls the timing of starting driving of the holder 11, the amount of driving, the driving direction, the driving speed, etc. The holder drive controller 42 may control the driving of the holder 11 based on a sewing program or the like stored in the storage part 20. The driver 12 drives the holder 11 under the control of the holder drive controller 42.

The needle drive controller 43 controls the operation of outputting a signal from the signal output part 15. The needle drive controller 43 is capable of adjusting the moving speed of the sewing needle 3 according to the thickness of the fabric S and the amount of driving of the holder 11 in the previous period, during the period when the pressing member 33 is separated from the fabric S, based on the detection result of the position detector 13.

The storage part 20 stores information such as various programs and data. The storage part 20 includes storages such as an HDD (Hard Disk Drive) and an SSD (Solid State Drive).

In the controller 16, the processor in the processing part 19 reads various programs and expands the programs into the memories, thereby executing information processing corresponding to the functions of each part mentioned above. The various programs include, for example, programs stored in the storage part 20, programs recorded on an external recording medium, etc. The controller 16 functions as an information processing device (computer) that executes various information processing. Nevertheless, an information processing device different from the controller 16 may execute the various programs, or the controller 16 and other information processing devices may cooperate to execute the various programs.

The following will describe an example of a buttonhole forming method using the sewing machine 1 and the sewing machine external unit 10 configured as described above. First, the operator rotates a pulley 8 to place the sewing needle 3 at the raised position, and mounts the sewing machine external unit 10. In this case, the operator mounts the housing 10A onto the bed 7 of the sewing machine 1. The operator may mount the housing 10A to a preset position on the bed 7 by fixing the housing 10A with screws or the like. By mounting the housing 10A, the openings 21*a* and 22*a* of the lower plate 21 and the upper plate 22 of the holder 11 protruding from the housing 10A are arranged directly below the sewing needle 3.

Then, the operator connects the signal output part 15 to the connector of the sewing machine 1 to which the foot pedal is connected. Thereby, a needle drive signal for driving the sewing needle 3 is supplied from the signal output part 15 to the sewing machine 1.

Further, the operator removes the presser plate attached to the sewing machine 1 and attaches the position detector 13 to the location where the presser plate was attached. By attaching the position detector 13, the pressing member 33 is arranged in place of the presser plate.

After mounting the sewing machine external unit 10 as described above, settings such as buttonhole pattern are input using the input part of the operation panel 14. After inputting the settings, the operator inputs an operation to start the operation. When this input is received, the holder drive controller 42 in the controller 16 moves the holder 11 to the optimum initial position based on the settings such as buttonhole pattern. The initial position may be stored in the storage part 20 in association with the buttonhole setting. The holder drive controller 42 is capable of moving the holder 11 based on the information stored in the storage part 20.

After the holder 11 moves to the initial position, the operator enables the holder 11 to hold the fabric S, which is the object to be sewn. The operator operates the clamp mechanism 23 to separate the upper plate 22 upward from the lower plate 21. In this state, the operator adjusts the position of the fabric S so as to place the sewing start position for forming a buttonhole on the fabric S directly below the sewing needle 3. The fabric S is easily aligned by marking the sewing start position on the fabric S in advance. The operator may rotate the pulley 8 to lower the sewing needle 3 and check the sewing start position and the position of the sewing needle 3. After aligning the position of the fabric S, the operator operates the clamp mechanism 23 to press the upper plate 22 against the lower plate 21. Thereby, the fabric S is held between the lower plate 21 and the upper plate 22.

After holding the fabric S, the operator inputs an operation to start the operation again. When this input is received, the needle drive controller 43 in the controller 16 controls the signal output part 15 to output a needle drive signal for moving the sewing needle 3 up and down to the sewing machine 1. The sewing machine 1 is supplied with the needle drive signal output from the signal output part 15. The sewing machine 1 moves the sewing needle 3 up and down based on the needle drive signal. The pressing member 33 moves up and down in response to the movement of the sewing needle 3. The pressing member 33 presses the fabric S while the sewing needle 3 is stuck in the fabric S, and rises together with the sewing needle 3 when the sewing needle 3 comes out of the fabric S and rises. Thus, the fabric S is suppressed from shifting in position.

As the sewing needle 3 moves up and down, the movement of the sewing needle 3 and the pressing member 33 is detected by the first optical sensor 34 and the second optical sensor 35 of the position detector 13. In the state where the pressing member 33 is pressing the fabric S, the first optical sensor 34 of the position detector 13 outputs an electrical signal of a constant value. On the other hand, in the state where the needle abutting member 36 is pushed up by the fixing member 3*a* and the pressing member 33 is separated from the fabric S as the sewing needle 3 rises and comes out of the fabric S, the first optical sensor 34 outputs a pulsed electrical signal. Therefore, the analyzer 41 determines that the pressing member 33 is warped from the fabric S when the detection result of the first optical sensor 34 is a pulsed electrical signal.

Figure 12A:
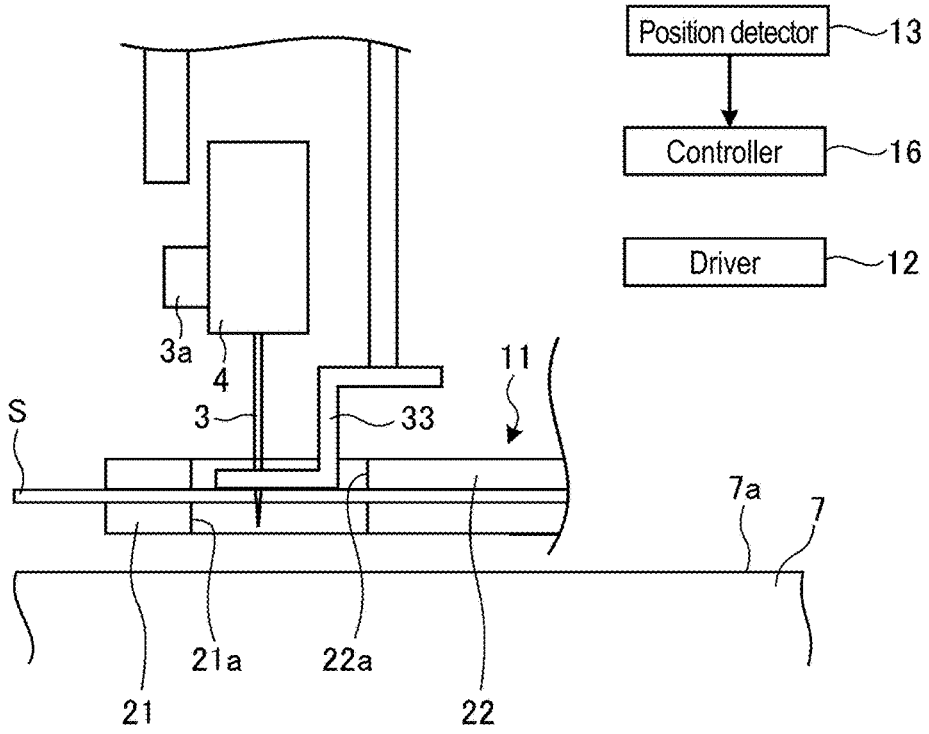
FIG. 12A and FIG. 12B are diagrams schematically showing an example of driving of the driver.
Figure 12B:
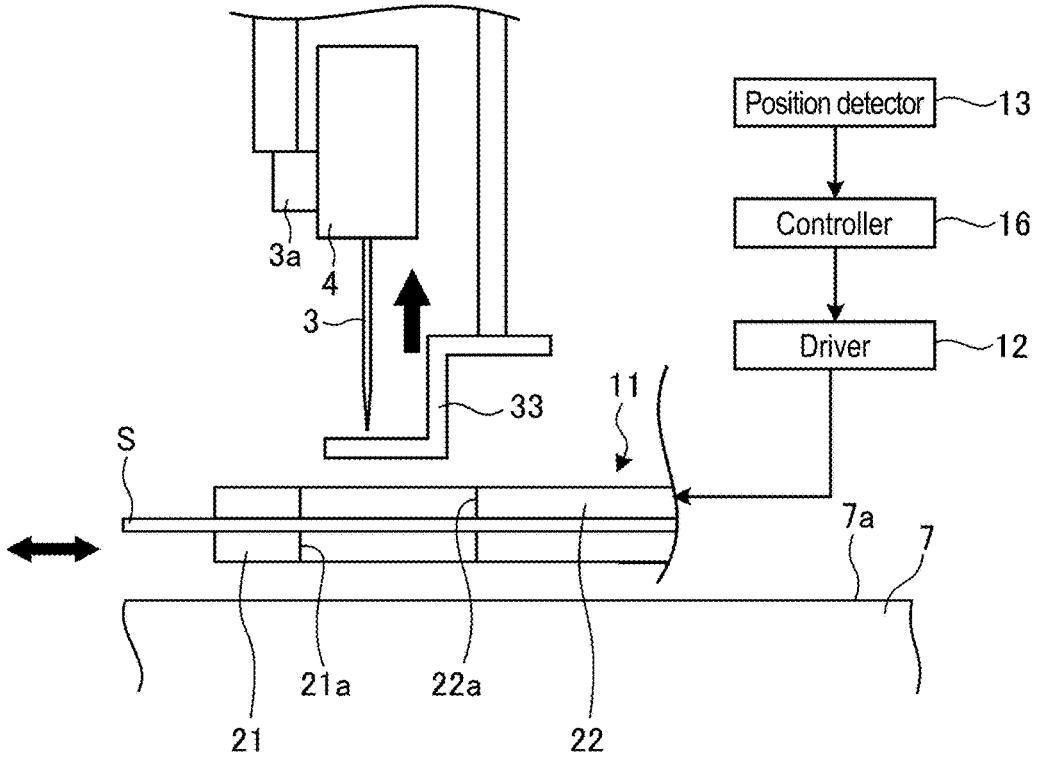

The holder drive controller 42 causes the driver 12 to drive the holder 11 as the sewing needle 3 moves up and down so that a preset buttonhole pattern is formed on the fabric S. FIG. 12A and FIG. 12B are diagrams schematically showing an example of driving of the driver 12. As shown in FIG. 12A and FIG. 12B, the holder drive controller 42 does not drive the holder 11 during a period when the pressing member 33 is pressing the fabric S, based on the analysis result of the analyzer 41. Furthermore, the holder drive controller 42 drives the holder 11 during a period when the pressing member 33 is separated from the fabric S, based on the analysis result of the analyzer 41. This control may prevent interference between the pressing member 33 and the holder 11.

In addition, the holder drive controller 42 is capable of changing the timing of starting the driving of the holder 11. For example, the timing may be changed based on settings made by the operator, or information that serves as a trigger for changing the timing may be stored in the storage part 20, and the timing may be changed automatically based on the information.

Figure 13:
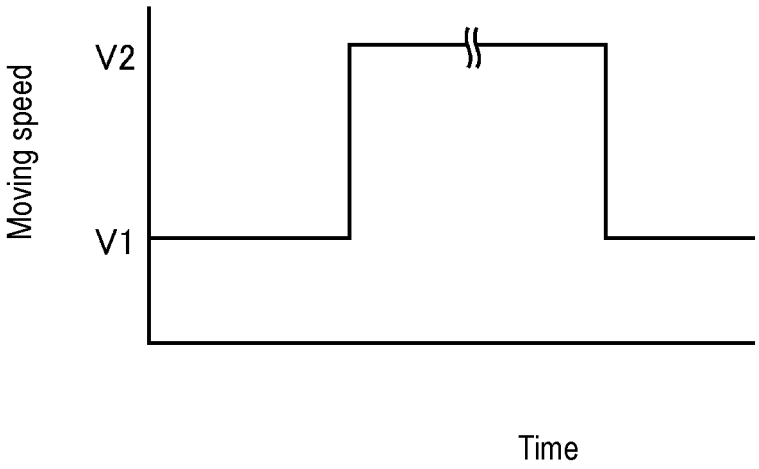
FIG. 13 schematically shows an example of adjusting the moving speed of the sewing needle.

Further, the needle drive controller 43 is capable of adjusting the moving speed of the sewing needle 3 during the period when the pressing member 33 is removed from the fabric S. FIG. 13 schematically shows an example of adjusting the moving speed of the sewing needle 3. As shown in FIG. 13, the needle drive controller 43 is capable of adjusting the moving speed of the sewing needle 3 stepwise between a low speed V1 and a high speed V2. Although FIG. 13 shows an example of adjustment in two stages, the speed may be adjusted in three or more stages.

The needle drive controller 43 may adjust the moving speed of the sewing needle 3 according to the thickness of the fabric S, for example. In the case where the fabric S is thick, the distance from when the pressing member 33 leaves the fabric S to when the pressing member 33 returns becomes short. Therefore, in order to move the holder 11 so as not to interfere with the pressing member 33, it is necessary to move the holder 11 at a higher speed than in the case where the fabric S is thin. Regarding this, by setting the moving speed of the sewing needle 3 to the low speed V1 through the needle drive controller 43, interference between the holder 11 and the pressing member 33 may be avoided without changing the moving speed of the holder 11.

In addition, the needle drive controller 43 may adjust the moving speed of the sewing needle 3 according to the amount of driving of the holder 11. In the case where the amount of driving of the holder 11 is large, the moving distance becomes long, so in order to move the holder 11 so as not to interfere with the pressing member 33, it is necessary to move the holder 11 at a higher speed than in the case where the amount of driving of the holder 11 is small. Regarding this, by setting the moving speed of the sewing needle 3 to the low speed V1 through the needle drive controller 43, interference between the holder 11 and the pressing member 33 may be avoided without changing the moving speed of the holder 11.

In the case of forming a seam along the X direction on the fabric S, the holder drive controller 42 arranges the portions of the openings 21*a* and 22*a* of the holder 11, which extend in the X direction, below the sewing needle 3, and moves the holder 11 in the X direction. Additionally, in the case of forming a seam along the Y direction on the fabric S, the holder drive controller 42 arranges the portions of the openings 21*a* and 22*a* of the holder 11, which extend in the Y direction, below the sewing needle 3, and moves the holder 11 in the Y direction. For example, when the operator first inputs an operation to start the operation or when switching the moving direction of the holder 11 between the X direction and the Y direction, the holder drive controller 42 performs an operation to move the holder 11 to a predetermined origin position.

In the case of performing an operation of switching the origin position of the holder 11, the holder drive controller 42 starts to move the holder 11 when the sewing needle 3 rises and is placed at the raised position. In the case where the sewing needle 3 is placed below the raised position, the second optical sensor 35 outputs a signal of a low value indicating a state where no light is detected. When the sewing needle 3 rises and is placed at the raised position, the second optical sensor 35 outputs a signal of a high value indicating a state where light has been detected. Thus, in the case where the detection result of the second optical sensor 35 is an electrical signal of a high value, the analyzer 41 determines that the sewing needle 3 has reached the raised position.

The holder drive controller 42 controls the driver 12 to switch the origin position of the holder 11 when the sewing needle 3 is placed at the raised position, based on the analysis result of the analyzer 41. This control may reliably prevent interference between the sewing needle 3 and the holder 11 when switching the origin position of the holder 11.

As described above, the sewing machine external unit 10 according to this embodiment includes: the holder 11 configured to hold the fabric S; the driver 12 configured to be detachable from the bed 7 of the sewing machine 1 and drive the holder 11 along the upper surface 7*a* of the bed 7; the pressing member 33 configured to move in the up-down direction according to movement of the sewing needle 3 of the sewing machine 1 in the up-down direction, press the fabric S while the sewing needle 3 is stuck in the fabric S, and rise together with the sewing needle 3 in response to the sewing needle 3 coming out of the fabric S and rising; the position detector 13 configured to detect the position of the pressing member 33 in the up-down direction; the signal output part 15 configured to output a signal to the sewing machine 1; and the controller 16 configured to be capable of outputting a needle drive signal for driving the sewing needle 3 from the signal output part 15 to the sewing machine 1, and control driving of at least one of the holder 11 and the sewing needle 3 based on the detection result of the position detector 13.

According to this configuration, the position of the pressing member 33 in the up-down direction is detected by the position detector 13, and the driving of at least one of the holder 11 and the sewing needle 3 is controlled by the driver 12 based on the detection result, allowing control over the vertical movement of the pressing member 33 and the horizontal movement of the fabric S at an appropriate timing, and thereby, improving the quality of sewing.

In the sewing machine external unit 10 according to this embodiment, the controller 16 is configured to detect whether the pressing member 33 is separated from the fabric S based on the detection result of the position detector 13, and control the driver 12 to drive the holder 11 during the period when the pressing member 33 is separated from the fabric S. This configuration may reliably prevent interference between the pressing member 33 and the holder 11.

In the sewing machine external unit 10 according to this embodiment, the controller 16 is configured to adjust the moving speed of the sewing needle 3 according to the thickness of the fabric S when controlling the driver 12 during the period when the pressing member 33 is separated from the fabric S. By adjusting the moving speed of the sewing needle 3 according to the thickness of the fabric S, this configuration may reliably prevent interference between the pressing member 33 and the holder 11.

In the sewing machine external unit 10 according to this embodiment, the controller 16 is configured to adjust the moving speed of the sewing needle 3 according to the amount of driving of the holder 11 in the period when controlling the driver 12 during the period when the pressing member 33 is separated from the fabric S. By adjusting the moving speed of the sewing needle 3 according to the amount of driving of the holder 11, this configuration may reliably prevent interference between the pressing member 33 and the holder 11.

In the sewing machine external unit 10 according to this embodiment, the position detector 13 is configured to be capable of detecting the amount of movement of the pressing member 33 in the up-down direction, and the controller 16 is configured to calculate the thickness of the fabric S based on the amount of movement. This configuration enables the thickness of the fabric S to be calculated with high accuracy.

In the sewing machine external unit 10 according to this embodiment, the position detector 13 includes: the movable body 31 that is supported by the sewing machine 1 so as to rise together with the sewing needle 3 and the pressing member 33 in response to the sewing needle 3 coming out of the fabric S and rising, and has a pattern formed along the up-down direction; and the first optical sensor 34 and the second optical sensor 35 that are supported by the sewing machine 1 in the state where movement in the up-down direction is restricted, and detect movement of the movable body 31 by detecting movement of the pattern. By using the movable body 31, the first optical sensor 34, and the second optical sensor 35, this configuration enables the position of the sewing needle 3 to be detected with high accuracy.

The technical scope of the disclosure is not limited to the above embodiment, and changes can be made as appropriate without departing from the spirit of the disclosure. For example, in the above embodiment, the sewing machine external unit 10 has been described as being used for forming buttonholes, but the disclosure is not limited to this application. The sewing machine external unit 10 may also be used when forming patterns other than buttonholes.

What is claimed is:

1. A sewing machine external unit, comprising:

a holder configured to hold fabric;

a driver configured to be detachable from a bed of a sewing machine and drive the holder along an upper surface of the bed;

a pressing member configured to move in an up-down direction according to movement of a sewing needle of the sewing machine in the up-down direction, press the fabric while the sewing needle is stuck in the fabric, and rise together with the sewing needle in response to the sewing needle coming out of the fabric and rising;

a position detector configured to detect a position of the pressing member in the up-down direction;

a signal output part configured to output a needle drive signal to the sewing machine; and a controller configured to control the signal output part to output the needle drive signal to the sewing machine for driving the sewing needle, and control driving of at least one of the holder and the sewing needle based on a detection result of the position detector, wherein the controller is entirely located in the sewing machine external unit, and the needle drive signal drives the sewing needle to move in the up-down direction.

2. The sewing machine external unit according to claim 1, wherein the controller is configured to detect whether the pressing member is separated from the fabric based on the detection result of the position detector, and control the driver to drive the holder during a period when the pressing member is separated from the fabric.

3. The sewing machine external unit according to claim 2, wherein the controller is configured to adjust a moving speed of the sewing needle according to a thickness of the fabric when controlling the driver during the period when the pressing member is separated from the fabric.

4. The sewing machine external unit according to claim 2, wherein the controller is configured to adjust a moving speed of the sewing needle according to an amount of driving of the holder in the period when controlling the driver during the period when the pressing member is separated from the fabric.

5. The sewing machine external unit according to claim 1, wherein the position detector is configured to be capable of detecting an amount of movement of the pressing member in the up-down direction, and the controller is configured to calculate a thickness of the fabric based on the amount of movement.

6. The sewing machine external unit according to claim 1, wherein the position detector comprises:

a movable body that is supported by the sewing machine so as to rise together with the sewing needle and the pressing member in response to the sewing needle coming out of the fabric and rising, and has a pattern formed along the up-down direction; and a sensor that is supported by the sewing machine in a state where movement in the up-down direction is restricted, and detects movement of the movable body by detecting movement of the pattern.

* * * * *